US010161210B2

(12) United States Patent
Thornburrow

(10) Patent No.: US 10,161,210 B2
(45) Date of Patent: Dec. 25, 2018

(54) HYDRAULICALLY ACTUATED WELLHEAD HANGER RUNNING TOOL

(71) Applicant: Cameron International Corporation, Houston, TX (US)

(72) Inventor: Edward T. Thornburrow, Drighlington (GB)

(73) Assignee: Cameron International Corporation, Houston, TX (US)

( * ) Notice: Subject to any disclaimer, the term of this patent is extended or adjusted under 35 U.S.C. 154(b) by 780 days.

(21) Appl. No.: 14/579,972

(22) Filed: Dec. 22, 2014

(65) Prior Publication Data

US 2016/0177652 A1 Jun. 23, 2016

(51) Int. Cl.
*E21B 33/04* (2006.01)

(52) U.S. Cl.
CPC ..... *E21B 33/04* (2013.01)

(58) Field of Classification Search
CPC ..... E21B 33/04; E21B 33/035; E21B 33/043
USPC ..... 166/379
See application file for complete search history.

(56) References Cited

U.S. PATENT DOCUMENTS

| | | | | |
|---|---|---|---|---|
| 3,543,847 | A * | 12/1970 | Haeber | E21B 33/043 166/115 |
| 4,053,023 | A | 10/1977 | Herd et al. | |
| 4,067,388 | A * | 1/1978 | Mouret | E21B 23/04 166/208 |
| 4,496,172 | A | 1/1985 | Walker | |
| 4,815,770 | A | 3/1989 | Hyne et al. | |
| 4,856,594 | A * | 8/1989 | Jennings | F16L 37/002 166/338 |
| 5,421,407 | A | 6/1995 | Thornburrow | |
| 5,735,344 | A * | 4/1998 | Duncan | E21B 33/04 166/115 |
| 6,138,762 | A | 10/2000 | Sweeney et al. | |
| 6,378,613 | B1 * | 4/2002 | Kent | E21B 33/035 166/368 |
| 2005/0034870 | A1 | 2/2005 | Buckle et al. | |
| 2008/0308278 | A1 | 12/2008 | Adamek et al. | |
| 2011/0247799 | A1 | 10/2011 | June et al. | |

* cited by examiner

*Primary Examiner* — Giovanna C. Wright
*Assistant Examiner* — Dany E Akakpo
(74) *Attorney, Agent, or Firm* — Eubanks PLLC

(57) ABSTRACT

Various tools for installing components in a wellhead housing are provided. In one embodiment, an apparatus includes a wellhead hanger running tool. The running tool includes a piston and a locking segment both disposed in a body of the running tool. The piston and the locking segment are positioned with respect to one another so as to allow the locking segment to be selectively driven by the piston to secure the running tool to a wellhead hanger received by the running tool. Additional systems, devices, and methods are also disclosed.

13 Claims, 6 Drawing Sheets

74
42
34
80
98
110
96
36
68
92
64
64
62
40
86
84
56
56
66
58
94
38
70
70
50
50
48
48
60
60
52
52
54
46
46
72
60
60
72
76
76
48
48
50
50
78
78
106
84
38
90
88
108

74
42
34
80
110
96
100
36
68
92
64
64
62
86
40
84
56
56
66
58
94
38
70
70
50
50
48
48
60
60
52
52
54
46
46
72
72
60
60
48
48
76
76
50
50
78
78
106
84
38
90
88
108

74
42
34
80
102
100
110
36
68
92
64
64
62
86
40
84
56
56
66
58
94
38
70
70
60
50
50
60
48
48
54
52
52
60
60
46
46
72
72
76
76
48
50
50
48
78
78
106
84
38
90
88
108

HYDRAULICALLY ACTUATED WELLHEAD HANGER RUNNING TOOL

BACKGROUND

This section is intended to introduce the reader to various aspects of art that may be related to various aspects of the presently described embodiments. This discussion is believed to be helpful in providing the reader with background information to facilitate a better understanding of the various aspects of the present embodiments. Accordingly, it should be understood that these statements are to be read in this light, and not as admissions of prior art.

In order to meet consumer and industrial demand for natural resources, companies often invest significant amounts of time and money in finding and extracting oil, natural gas, and other subterranean resources from the earth. Particularly, once a desired subterranean resource such as oil or natural gas is discovered, drilling and production systems are often employed to access and extract the resource. These systems may be located onshore or offshore depending on the location of a desired resource. Further, such systems generally include a wellhead assembly mounted on a well through which the resource is accessed or extracted. These wellhead assemblies may include a wide variety of components, such as various casings, valves, hangers, pumps, fluid conduits, and the like, that facilitate drilling or production operations.

As will be appreciated, various tubular strings can be run into wells through wellhead assemblies. For instance, wells are often lined with casing that generally serves to stabilize the well and to isolate fluids within the wellbore from certain formations penetrated by the well (e.g., to prevent contamination of freshwater reservoirs). Wells can also include tubing strings that facilitate flow of fluids through the wells. Hangers can be attached to the casing and tubing strings and received within wellheads to enable these tubular strings to be suspended in the wells from the hangers. Various components can also be provided in the well below the hangers. Control lines can be used to facilitate electronic or fluid communication with such components, and in some instances the control lines are coupled to the wellhead hangers.

SUMMARY

Certain aspects of some embodiments disclosed herein are set forth below. It should be understood that these aspects are presented merely to provide the reader with a brief summary of certain forms the invention might take and that these aspects are not intended to limit the scope of the invention. Indeed, the invention may encompass a variety of aspects that may not be set forth below.

The present disclosure generally relates to tools for installing wellhead hangers or other components in wellhead housings. In some instances, a running tool is hydraulically actuated to lock the running tool to a wellhead hanger. In one example, a running tool includes a piston that is actuated to drive locking segments of the running tool into engagement with a wellhead hanger. The running tool can also include an outer sleeve for selectively collapsing a locking ring, and the outer sleeve can be actuated to control locking of the wellhead hanger inside a wellhead housing via the locking ring. In certain embodiments, locking and unlocking of the running tool to the wellhead hanger, and of the wellhead hanger to the wellhead housing, can be accomplished through hydraulic actuation without requiring rotation of the running tool components. For example, a piston can be hydraulically actuated to lock the running tool to the wellhead hanger, the outer sleeve can be hydraulically actuated to collapse the locking ring of the wellhead hanger, and the running tool can be used to run the hanger into the wellhead housing. The outer sleeve can then be actuated to release the locking ring to secure the hanger in the wellhead housing, the piston can be actuated to unlock the running tool from the secured hanger, and the running tool can be pulled out of the wellhead housing.

Various refinements of the features noted above may exist in relation to various aspects of the present embodiments. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. Again, the brief summary presented above is intended only to familiarize the reader with certain aspects and contexts of some embodiments without limitation to the claimed subject matter.

BRIEF DESCRIPTION OF THE DRAWINGS

These and other features, aspects, and advantages of certain embodiments will become better understood when the following detailed description is read with reference to the accompanying drawings in which like characters represent like parts throughout the drawings, wherein.

DETAILED DESCRIPTION OF SPECIFIC EMBODIMENTS

Specific embodiments of the present disclosure are described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments, the articles "a," "an," "the," and "said" are intended to mean that there are one or more of the elements. The terms "comprising," "including," and "having" are intended to be inclusive and mean that there may be additional elements other than the listed elements. Moreover, any use of "top," "bottom," "above," "below," other directional terms, and variations of these terms is made for convenience, but does not require any particular orientation of the components.

Figure 1:
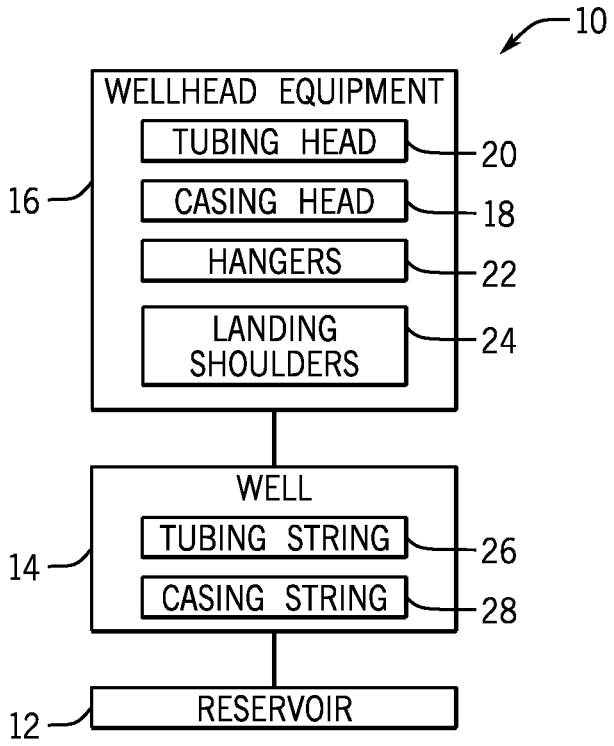
FIG. 1 generally depicts various components, including one or more tubular strings and associated hangers, that can be installed at a well in accordance with one embodiment of the present disclosure.

Turning now to the present figures, a system 10 is illustrated in FIG. 1 in accordance with one embodiment. Notably, the system 10 is a production system that facilitates extraction of a resource, such as oil, from a reservoir 12 through a well 14. Wellhead equipment 16 is installed on the well 14. As depicted, the wellhead equipment 16 includes at least one casing head 18 and tubing head 20, as well as wellhead hangers 22. But the components of the wellhead equipment 16 can differ between applications, and could include a variety of casing heads, tubing heads, spools, hangers, sealing assemblies, stuffing boxes, pumping tees, and pressure gauges, to name only a few possibilities.

The wellhead hangers 22 can be positioned on landing shoulders 24 within hollow wellhead bodies (e.g., within the tubing and casing heads). These landing shoulders 24 can be integral parts of tubing and casing heads or can be provided by other components, such as sealing assemblies (e.g., packoffs) or landing rings disposed in the tubing and casing heads. Each of the hangers 22 can be connected to a tubular string, such as a tubing string 26 or a casing string 28, to suspend the string within the well 14. The well 14 can include a single casing string 28 or include multiple casing strings 28 of different diameters. The well 14 could also include a single tubing string 26 or multiple tubing strings 26. Any suitable devices or machines may be used to run tubular strings into wells through wellheads and install hangers 22 attached to the tubular strings in the wellheads. For example, a top drive can be used to run a tubing string into a well and a tubing hanger into a wellhead.

Various running tools can be used to install wellhead hangers 22 or other components in a wellhead housing (e.g., a casing head 18 or a tubing head 20). While certain embodiments of running tools are described below in connection with installing a tubing hanger in a wellhead housing, it will be appreciated that other running tools could be used to install other components within a wellhead housing in accordance with the presently disclosed techniques.

Figure 2:
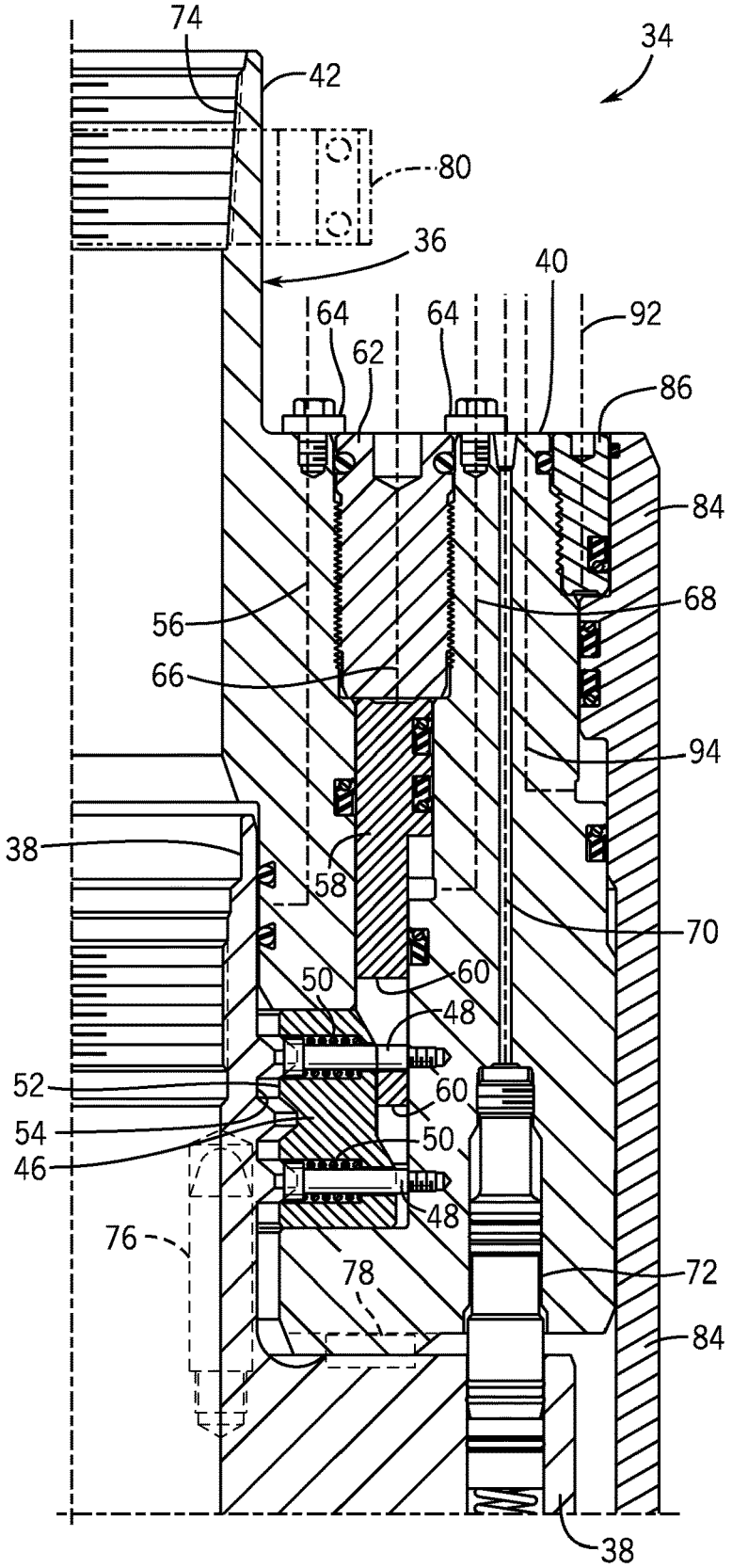
FIG. 2 is a partial section view of a hanger assembly including a wellhead hanger and a running tool for installing the wellhead hanger in a wellhead housing in accordance with one embodiment.
Figure 3:
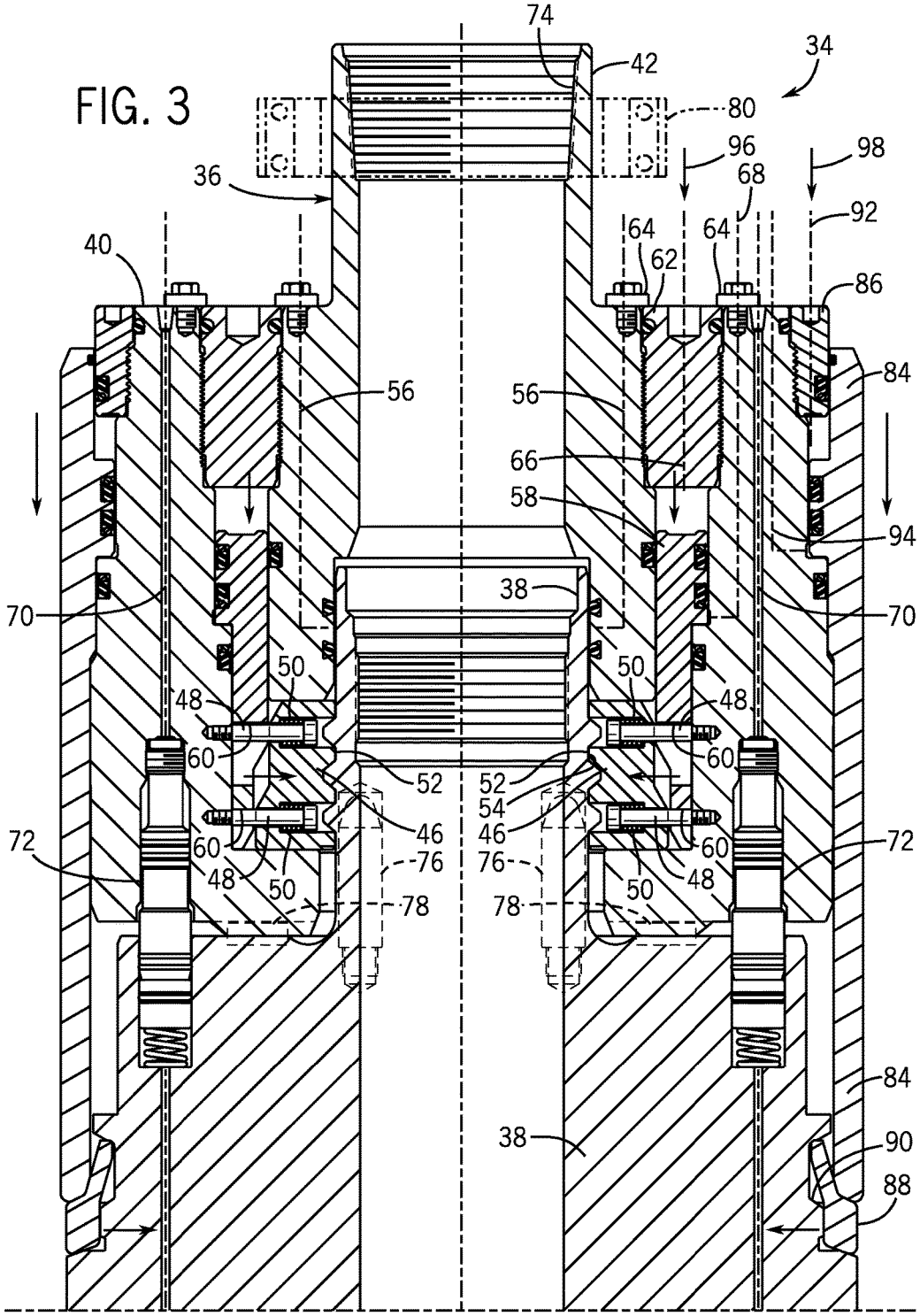
FIG. 3 is another section view of the hanger assembly of FIG. 2 showing additional details, such as locking segments of the running tool driven into engagement with the wellhead hanger by a piston, and an outer sleeve of the running tool retaining a locking ring in a collapsed position, in accordance with one embodiment.

By way of example, a wellhead hanger assembly 34 is shown in FIGS. 2 and 3 as including a running tool 36 on a tubing hanger 38. In this depicted embodiment, the running tool 36 has a multi-part main body including an outer body 40 and an inner body 42. The outer body 40 and the inner body 42 could be formed as a single, integral unit, or could be formed as separate components that are subsequently coupled to one another.

A locking segment 46 is disposed in the body for locking the running tool 36 to the tubing hanger 38. The locking segment 46 can be fastened to the running tool body in any suitable manner, such as with screws 48 inserted through the locking segment 46 and threaded into the outer body 40. Biasing springs 50 apply a radially outward bias to the locking segment 46 so as to bias the locking segment 46 toward a retracted position apart from the tubing hanger 38. The locking segment 46 includes a front face 52 for engaging a mating surface 54 of the tubing hanger 38. In some embodiments, the running tool 36 includes multiple locking segments 46, such as eight locking segments 46 arranged radially about an interior of the running tool 36. Two such locking segments 46 are shown on opposite sides of the tubing hanger 38 in FIG. 3. In another embodiment, a single locking segment 46 could instead be provided (e.g., a collapsible C-ring). Each of the locking segments 46 can be fastened to the body of the running tool 36 and biased with springs 50, as described above.

A piston 58 is also disposed in the body of the running tool 36 for actuating the locking segments 46. In the presently depicted embodiment, the piston 58 is disposed between the outer body 40 and the inner body 42 and includes slots 60 for allowing passage of the screws 48 from the locking segments 46 to the outer body 40 through the piston 58. The piston 58 and the locking segments 46 are positioned with respect to one another to allow the locking segments 46 to be selectively driven radially inward by the piston 58 to move the locking segments 46 from an unlocked position, as shown in FIG. 2, to a locked position, as shown in FIG. 3. In the locked position, the locking segments 46 are capable of sustaining the full weight of a tubing string 26 suspended from the tubing hanger 38. As shown in FIGS. 2 and 3, the front faces 52 of the locking segments 46 and the surface 54 have mating grooves and ridges for bearing the weight of the tubing string, although other load-bearing mating features could be used in other embodiments. Further, the piston 58 can be provided in any suitable form, such as a single annular piston or multiple pistons arranged radially about the inner body 42.

As shown in FIGS. 2 and 3, a retaining ring 62 retains the piston 58 within the body of the running tool 36. This retaining ring 62 can also serve as an attachment ring for coupling the outer body 40 to the inner body 42. For example, one manner of assembling the running tool 36 includes positioning the piston 58 within the outer body 40 (such as in the position illustrated in FIG. 3), fastening the locking segments 46 to the outer body 40 through the slots 60 of the piston 58, attaching the retaining ring 62 to the inner body 42 (e.g., via internal threads of the ring 62), and then attaching the retaining ring 62 to the outer body 40 (e.g., via external threads of the ring 62). Washers 64 (or some other suitable stop elements) can be fastened to the outer body 40 and the inner body 42 to prevent the retaining ring 62 from backing out of its recess between the two bodies 40 and 42.

After assembly, the running tool 36 can be aligned with the hanger 38 and the running tool 36 and the hanger 38 can then be moved into engagement (e.g., by lowering the running tool 36 onto the hanger 38). The body of the running tool 36 includes conduits for routing control fluid (e.g., hydraulic control fluid) into the body to actuate the piston 58 to lock or unlock the running tool 36 to the hanger 38. For instance, control fluid can be pumped into conduit 66 to lock the running tool 36 to the hanger 38 and into conduit 68 to unlock the running tool 36, as described in greater detail below. Various seals can be provided between components of the hanger assembly 34 to inhibit fluid leakage. Sealing test conduits can be provided in components of the assembly 34 to facilitate testing of seal integrity. Two such sealing test conduits 56, for testing sealing of tubing hanger neck seals, are generally depicted in FIG. 3 as examples.

Various downhole devices can be used within a well to facilitate desired well operations. Examples of such downhole devices include safety valves, other valves, chemical injection units, and controllers. In some instances, control lines are connected to such downhole devices to enable fluid communication with the devices. Control lines, for example, could be provided as fluid lines for control of hydraulically actuated components, such as valves, or for routing chemicals to a chemical injection unit. The control lines can extend up the well (e.g., along a tubing string) from the downhole devices to a tubing hanger, and fluid sources (e.g., at the surface) can be connected to the control lines through conduits in the tubing hanger.

As will be appreciated, it may be desirable to maintain pressure down one or more control lines (e.g., a control line to a downhole safety valve) while running a tubing hanger into a wellhead housing. In some cases, this has been accomplished using a two-part running tool having an inner part furnished with a number of annular seals for separating different control line galleries while allowing rotation of the running tool during installation of the tubing hanger in a wellhead. These galleries could be provided with different working pressures or fluid types (e.g., from fluid sources outside the well), and the annular seals can be bidirectional to facilitate separation of the galleries.

In contrast, at least some embodiments of the present technique include running tools having control line stab assemblies instead of a multi-gallery seal arrangement. In some embodiments, such as that depicted in FIGS. 2 and 3, the running tool 36 includes one or more control line conduits 70 and control line stab assemblies 72. These control line stab assemblies 72 facilitate fluid-tight connections of the conduits 70 in the running tool 36 with corresponding conduits in the hanger 38 to place the conduits 70 of the running tool 36 in fluid communication with control lines joined to the lower end of the hanger 38. Fluid hoses or other conduits can be connected between fluid sources and the upper ends of conduits 70 of the running tool 36 to allow fluid communication between the fluid sources and downhole devices (through the running tool 36, the hanger 38, and control lines below the hanger 38). In some embodiments, the running tool 36 includes hydraulic control line stab assemblies 72 arranged radially around the tool (e.g., four, six, or eight assemblies 72 spaced evenly about the lower end of a running tool 36).

The running tool 36 or the hanger 38 can include a guide pin 76 to ensure proper alignment of the control line stab assemblies during connection of the running tool 36 and the hanger 38. For example, as depicted in FIG. 3, the hanger 38 includes two guide pins 76, which are received in recesses of the running tool 36. During assembly, the running tool 36 and the hanger 38 can be radially aligned so that the guide pins 76 are aligned with their mating recesses. Receipt of the guide pins 76 in the mating recesses during connection of the running tool 36 to the hanger 38 ensures radial alignment of the conduits 70 in the tool 36 with corresponding conduits in hanger 38 and facilitates connection of the stab assemblies 72. One or more anti-shear keys 78 can be provided between the running tool 36 and the hanger 38 to limit relative rotation of these components and possible shear stress on the stab assemblies 72.

As presently shown, an upper end of the inner body 42 includes a threaded connection surface 74. A landing joint (or string) can be threaded to the inner body 42 at the surface 74 and used to lower the hanger assembly 34 into a wellhead. A clamp 80 can be attached to the upper end of the inner body 42 and used for holding various control lines and hydraulic actuation lines connected to the running tool 36.

The running tool 36 also includes an outer sleeve 84 for collapsing and releasing a locking ring 88 carried in a groove 90 of the tubing hanger 38. In the presently depicted embodiment, the outer sleeve 84 is retained on the outer body 40 with a threaded retaining ring 86. With the running tool 36 connected to the tubing hanger 38, the outer sleeve 84 can be lowered to collapse and retain the locking ring 88 (e.g., a C-ring) in the groove 90.

In at least some embodiments, including that depicted in FIG. 3, the outer sleeve 84 is hydraulically actuated. Particularly, hydraulic control fluid can be routed through conduit 92 to cause downward movement of the outer sleeve 84 (to collapse the locking ring 88) and through conduit 94 to cause upward movement of the outer sleeve 84 (to release the ring 88). And as noted below, the released locking ring 88 can expand into a mating groove of a wellhead housing to lock the hanger 38 to the wellhead housing. In at least some embodiments, the capability to hydraulically actuate both the piston 58 (to control locking of the tool 36 to the hanger 38) and the outer sleeve 84 (to control locking of the hanger 38 to a wellhead) allows running and installation of the hanger 38 in the wellhead housing without requiring rotation of the running tool 36. For example, the piston 58 and the outer sleeve 84 can be moved axially with respect to the outer body 40 of the running tool 36 to control the locking functions without requiring rotation of the piston 58, the sleeve 84, or the body of the running tool 36 (e.g., with a landing joint).

Before lowering the hanger assembly 34 into a wellhead, hydraulic pressure can be applied via conduits 66 and 92, as generally indicated by arrows 96 and 98 in FIG. 3. More specifically, pressure can be applied through conduit 66 to drive the piston 58 downward to wedge the piston 58 between the locking segments 46 and the outer body 40 (as shown in FIG. 3). This drives the locking segments 46 inward into engagement with the hanger 38, thereby locking the tool 36 to the hanger 38. This also compresses the biasing springs 50. Pressure can be applied through conduit 92 to hydraulically actuate the outer sleeve 84 to collapse and retain the locking ring 88 in the groove 90.

Figure 4:
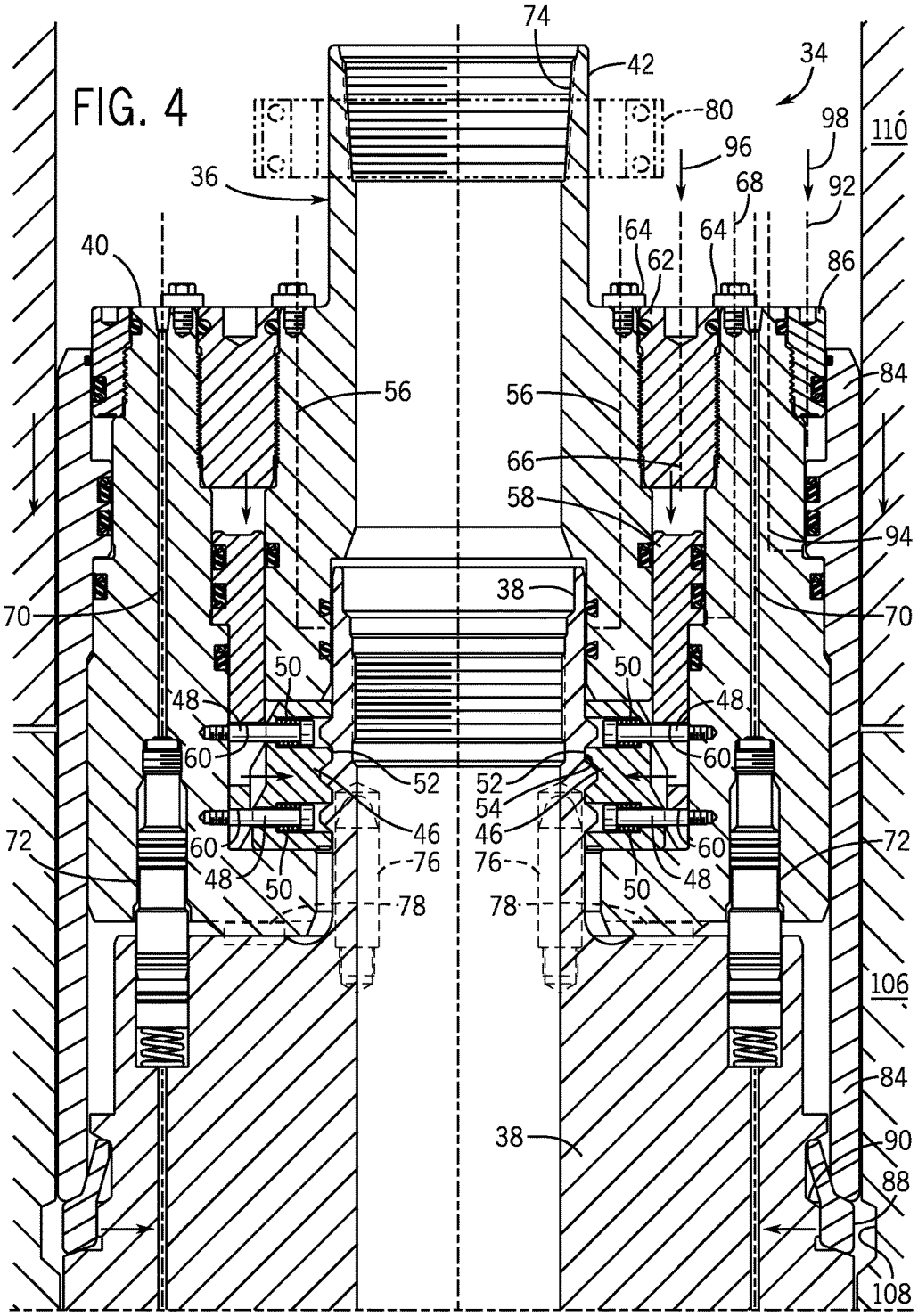
FIG. 4 is a section view showing the hanger assembly of FIG. 3 lowered into a wellhead housing in accordance with one embodiment.
Figure 5:
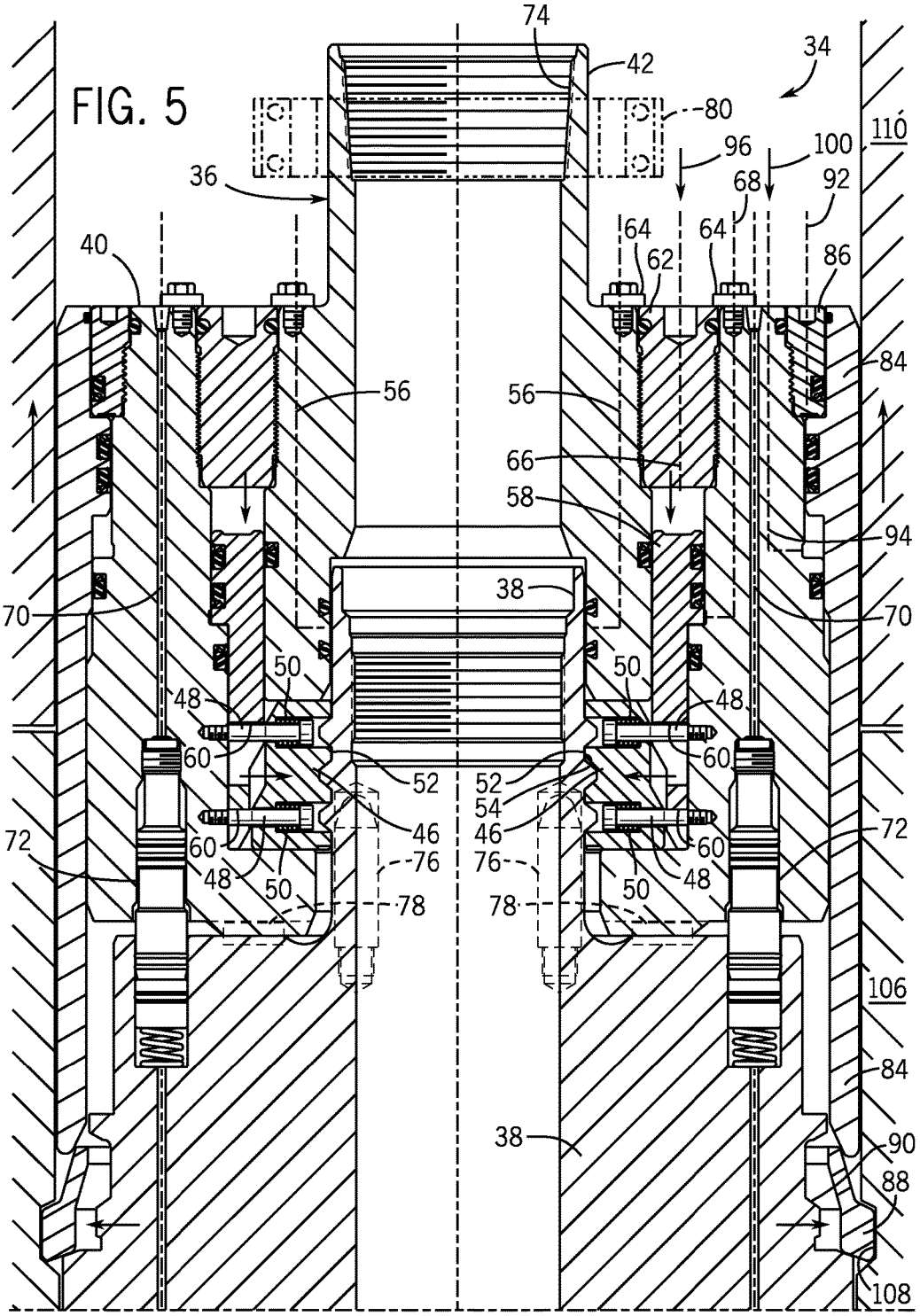
FIG. 5 is a section view of the hanger assembly in the wellhead housing of FIG. 4, but with the outer sleeve moved to a position that releases the locking ring and allows the locking ring to engage the wellhead housing to secure the wellhead hanger within the housing in accordance with one embodiment.

The pressure applied through conduits 66 and 92 can be maintained as the hanger assembly 34 is lowered (e.g., by a top drive connected with a landing joint) into a wellhead housing 106 through other equipment 110 (e.g., a blowout preventer stack or riser coupled to the wellhead housing 106), as depicted in FIG. 4. The hanger 38 can be landed in the wellhead housing 106 with the locking ring 88 axially aligned with a mating groove 108 of the housing 106. As shown in FIG. 5, the outer sleeve 84 can then be actuated by applying hydraulic pressure through conduit 94 (as generally indicated by arrow 100), rather than through conduit 92, to move the sleeve 84 upward and release the collapsible locking ring 88. This allows the ring 88 to expand outwardly into the groove 108, locking the hanger 38 in place within the wellhead housing 106.

Figure 6:
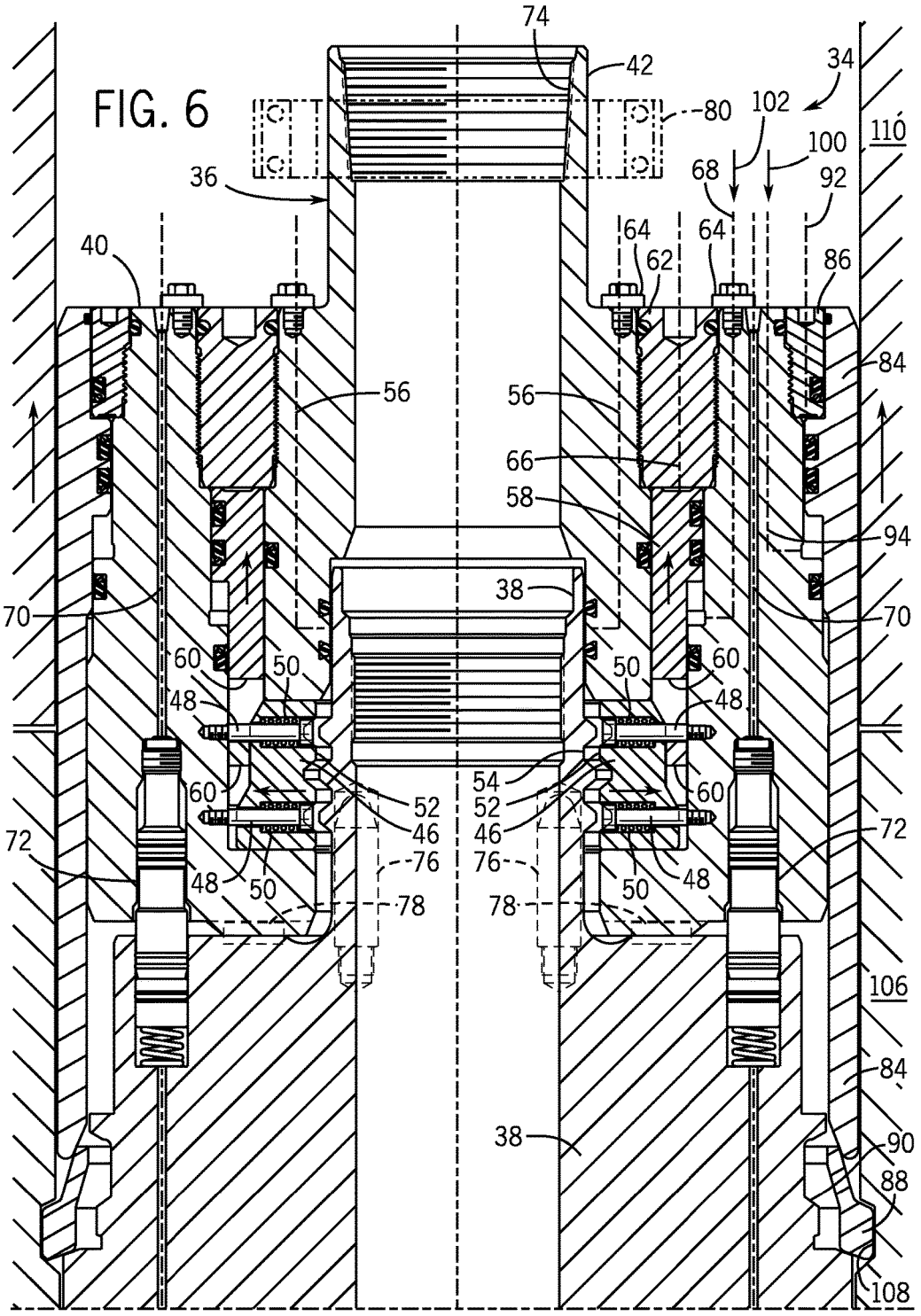
FIG. 6 is a section view of the hanger assembly in the wellhead housing that differs from FIG. 5 in that the piston has been retracted to allow the locking segments to disengage from the wellhead hanger in accordance with one embodiment.

Once the hanger 38 is installed in the housing 106, hydraulic pressure can be applied through conduit 68 (as generally indicated by arrow 102) to drive the piston 58 upward, as shown in FIG. 6. This allows the biasing springs 50 to expand, causing the locking segments 46 to retract to their unlocked position. The unlocked running tool 36 can then be disconnected from the hanger 38 and removed by pulling the tool 36 up through the equipment 110.

While the aspects of the present disclosure may be susceptible to various modifications and alternative forms, specific embodiments have been shown by way of example in the drawings and have been described in detail herein. But it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. An apparatus comprising:

a wellhead hanger; and a wellhead hanger running tool including:

a piston disposed in a body of the wellhead hanger running tool; and a locking segment disposed in the body of the wellhead hanger running tool and positioned with respect to the piston to allow the locking segment to be selectively driven by the piston to secure the wellhead hanger running tool to a wellhead hanger when the wellhead hanger is received by the wellhead hanger running tool;

wherein the wellhead hanger running tool is locked to the wellhead hanger by the locking segment, the wellhead hanger is a tubing hanger, and the tubing hanger and the wellhead hanger running tool include conduits connected in fluid communication by a control line stab assembly.

2. The apparatus of claim 1, comprising multiple locking segments disposed in the body of the wellhead hanger running tool and positioned with respect to the piston to allow the multiple locking segments to be selectively driven by the piston to secure the wellhead hanger running tool to the wellhead hanger when the wellhead hanger is received by the wellhead hanger running tool.

3. The apparatus of claim 2, wherein the multiple locking segments are fastened to the wellhead hanger running tool.

4. The apparatus of claim 3, comprising springs that bias the multiple locking segments toward a retracted position.

5. The apparatus of claim 3, wherein the wellhead hanger running tool includes an inner body and an outer body, the piston is positioned between the inner body and the outer body, and the multiple locking segments are fastened to the outer body.

6. The apparatus of claim 1, comprising a key installed between the wellhead hanger and the wellhead hanger running tool to limit relative rotation of the wellhead hanger with respect to the wellhead hanger running tool.

7. The apparatus of claim 1, comprising a guide pin that facilitates radial alignment of the tubing hanger and the wellhead hanger running tool to ensure proper alignment and connection of the control line stab assembly when the tubing hanger is received by the wellhead hanger running tool.

8. The apparatus of claim 1, wherein the wellhead hanger running tool includes a hydraulically actuated outer sleeve for selectively collapsing a locking ring of the wellhead hanger.

9. A system comprising:

a tubing hanger;

a running tool coupled to the tubing hanger, the running tool including an inner body, an outer body, a piston disposed between the inner body and the outer body, and a locking segment connected to the outer body, wherein the piston is positioned between the locking segment and the outer body and the locking segment is biased toward an unlocked position but held in a locked position against the tubing hanger by the piston, and wherein the running tool is configured to be hydraulically actuated to control locking of the running tool to the tubing hanger via the piston and the locking segment and to control locking of the tubing hanger to a wellhead housing.

10. The system of claim 9, wherein the inner body is coupled to the outer body via a threaded attachment ring.

11. The system of claim 9, wherein the tubing hanger is disposed within the wellhead housing and locked into place within the wellhead housing through mating engagement of a locking ring with a groove of the wellhead housing.

12. A method comprising:

aligning a wellhead hanger and a running tool;

moving the wellhead hanger and the running tool into engagement;

locking the running tool to the wellhead hanger by actuating a piston of the running tool to drive a locking segment of the running tool against a mating surface of the wellhead hanger;

lowering the wellhead hanger into a wellhead housing via the running tool; and after lowering the wellhead hanger into the wellhead housing, locking the wellhead hanger to the wellhead housing by moving an outer sleeve of the running tool with respect to the wellhead hanger;

wherein aligning the wellhead hanger and the running tool includes radially aligning the wellhead hanger and the running tool such that a guide pin is aligned with a mating recess, and moving the wellhead hanger and the running tool into engagement includes receiving the guide pin in the mating recess to align and connect control line stab assemblies between the running tool and the wellhead hanger.

13. The method of claim 12, comprising, after locking the wellhead hanger to the wellhead:

unlocking the running tool from the wellhead hanger by actuating the piston to release the locking segment from the mating surface of the wellhead hanger;

disconnecting the running tool from the wellhead hanger; and removing the disconnected running tool from the wellhead housing.

* * * * *